US008357109B2

(12) United States Patent
DeStefano

(10) Patent No.: US 8,357,109 B2
(45) Date of Patent: Jan. 22, 2013

(54) MUSCLE TREATMENT DEVICE

(76) Inventor: Robert Louis DeStefano, Lodi, NJ (US)

( * ) Notice: Subject to any disclaimer, the term of this patent is extended or adjusted under 35 U.S.C. 154(b) by 759 days.

(21) Appl. No.: 12/547,550

(22) Filed: Aug. 26, 2009

(65) Prior Publication Data

US 2011/0054369 A1 Mar. 3, 2011

(51) Int. Cl.
*A61H 7/00* (2006.01)

(52) U.S. Cl. ..... 601/134; 601/135

(58) Field of Classification Search ..... 601/118, 601/119, 129, 134, 135–137
See application file for complete search history.

(56) References Cited

U.S. PATENT DOCUMENTS

| | | | | |
|---|---|---|---|---|
| 708,313 | A | 9/1902 | Buck | |
| 3,637,205 | A | 1/1972 | Bankston | |
| 3,831,592 | A * | 8/1974 | Lancellotti | 601/135 |
| 4,395,039 | A | 7/1983 | Kaiser | |
| 4,452,237 | A * | 6/1984 | Lewis | 601/134 |
| 5,577,996 | A | 11/1996 | Gardner et al. | |
| 6,090,045 | A | 7/2000 | Leahy et al. | |
| 6,283,916 | B1 | 9/2001 | Leahy et al. | |
| 6,491,651 | B1 | 12/2002 | Leahy et al. | |
| 7,320,668 | B1 * | 1/2008 | Warder | 601/136 |
| D586,470 | S * | 2/2009 | Warder | D24/211 |
| 2003/0176264 | A1 | 9/2003 | Burns | |
| 2008/0103421 | A1 | 5/2008 | Nicholson | |

OTHER PUBLICATIONS

Thera Cane, www.theracane.com/index.html, 2010.
Thera Cane, www.theracane.com/product_up_close, 2010.
Thera Cane, www.theracane.com/product_at_a_glance, 2010.

* cited by examiner

*Primary Examiner* — Michael A. Brown
(74) *Attorney, Agent, or Firm* — Lerner, David, Littenberg, Krumholz & Mentlik, LLP

(57) ABSTRACT

Muscle treatment devices and methods are described for applying pressure to and facilitating the stretch of muscles in a body. The muscle treatment device preferably includes an elongate shaft, an intermediate member engaged to the shaft, and at least one muscle treatment member engaged to both the shaft and intermediate member such that in use, the at least one muscle treatment member is prevented from rotating around the longitudinal axis of the shaft. In a method if using the device to facilitating the stretch of muscles in a body, a patient preferably shortens the muscle being treated, applies angular pressure to the muscle by contacting skin tissue such that it directly affects and/or pins the underlying targeted muscular structure of the muscle with the outer surface of the at least one muscle treatment member, and then lengthens the muscle.

24 Claims, 17 Drawing Sheets

MUSCLE TREATMENT DEVICE

FIELD OF THE TECHNOLOGY

The present invention relates to muscle treatment devices and methods for applying pressure to and facilitating the stretch of muscles in a body, and particularly relates to such devices having first and/or second muscle treatment members connected to an intermediate member and an elongate rigid shaft such that the muscle treatment members are prevented from rotating around a longitudinal axis of the shaft during muscle treatment.

BACKGROUND OF THE INVENTION

Muscle aches and pains are common and can involve more than one muscle. Muscle pain also can involve ligaments, tendons, fascia (the soft tissues that connect muscles), bones, and organs. Muscle pain is most frequently related to tension, overuse, or muscle injury from exercise or physically-demanding work. In these situations, the pain tends to involve specific muscles and starts during or just after the activity and may persist if not treated appropriately.

Muscle pain also can be a sign of conditions affecting your whole body, like some infections (i.e. the flu) and disorders that affect connective tissues throughout the body (i.e. lupus). One common cause of muscle aches and pain is fibromyalgia, a condition that includes tenderness in muscles and surrounding soft tissue, sleep difficulties, fatigue, and headaches.

In the case of muscle pain from overuse or injury, a patient may attempt to treat the muscle by resting that part of the body or by taking an anti-inflammatory medication such as acetaminophen or ibuprofen. Other treatments may include applying ice to the injury to reduce pain and inflammation. The application of heat to the affected area may also be used to soothe the injured muscle. Muscle aches from overuse and fibromyalgia may respond well to massage. Gentle stretching exercises after a long rest period may also be helpful. However, there are many injuries where such remedies will not be helpful and will need the expertise of a physical therapist, chiropractor, or the like. Such a medical professional may be able to facilitate the healing of injured muscles by applying the appropriate pressure above or below the injury in order to: facilitate healing to the injured site by focusing a stretch to the injury; or by reducing tension around the injury, thereby allowing the injury to heal better due to relief from duress. All this in order to relax muscle tension and promote healing, for example.

Many people such as weightlifters, runners, and athletes in general, or non-athletes that have musculoskeletal injury, constantly have muscle aches and pains. The treatment regimen of shortening a muscle, applying pressure to an affected area of the muscle, and then lengthening the muscle is a proven muscle treatment technique that is well known within manual medicine. While medical professionals may apply this technique to patients, it is difficult and cumbersome for patients to perform self-treatment using this technique, especially on parts of the body that are difficult to reach with one's own hands. In addition, it is not always feasible for a patient to seek the aid of a medical professional every time he or she has a muscle strain or serious injury that needs treatment.

BRIEF SUMMARY OF THE INVENTION

A first aspect of the present invention is a muscle treatment device. In accordance with one embodiment of this first aspect, the muscle treatment device comprises an elongate rigid shaft having a longitudinal axis along the length thereof and an aperture extending through the shaft, the aperture having a longitudinal axis perpendicular to the longitudinal axis of the shaft. Preferably, a first muscle treatment member having an upper surface and an engagement portion is configured to engage and be retained within the aperture of the shaft. Preferably, the first muscle treatment member when engaged to the shaft is prevented from rotating around the longitudinal axis of the shaft.

In accordance with another embodiment of this first aspect, the aperture of the shaft and the engagement portion of the first muscle treatment member are both preferably threaded. Further, the elongate shaft preferably has a first lateral portion, an intermediate portion, and a second lateral portion. Preferably, the muscle treatment device further includes a first handle member and a second handle member, the first handle member configured to engage and be retained on the first lateral portion of the shaft and the second handle member configured to engage and be retained on the second lateral portion of the shaft.

In accordance with yet another embodiment of this first aspect, the muscle treatment device preferably further comprises an intermediate member engaging the intermediate portion of the shaft, the intermediate member having generally flat lower and upper surfaces and an aperture extending through the lower and upper surfaces, wherein the aperture of the shaft and the aperture of intermediate member are coaxial. Preferably, the first muscle treatment member has a generally flat lower surface that the engagement portion of the first muscle treatment member extends outwardly therefrom. The generally flat lower surface of the first muscle treatment member is preferably configured to matingly engage the generally flat upper surface of the intermediate member when the engagement portion of the first muscle treatment member is retained within the aperture of the intermediate member and the aperture of the shaft.

In accordance with still yet another embodiment of this first aspect, the muscle treatment device preferably further comprises a second muscle treatment member having a lower surface, an upper surface, and an engagement portion extending outwardly from the lower surface, the engagement portion configured to engage and be retained within the aperture of the shaft. Preferably, the upper surface of both the first and second muscle treatments members is convex. Preferably, the diameter of the convex upper surfaces of the first and second muscle treatment members varies such that each may produce a different pressure load on the muscle it comes in contact with.

In accordance with still yet another embodiment of this first aspect, the lower surface of the second muscle treatment member may be flat and configured to matingly engage the generally flat lower surface of the intermediate member when the engagement portion of the second muscle treatment member is retained within the aperture of the intermediate member and the aperture of the shaft. Preferably, the second muscle treatment member when engaged to the shaft is prevented from rotating around the longitudinal axis of the shaft.

A second aspect of the present invention is another muscle treatment device. In accordance with one embodiment of this second aspect, the muscle treatment device comprises an elongate rigid shaft having a longitudinal axis along the length thereof and an aperture extending through the shaft, the aperture having a longitudinal axis perpendicular to the longitudinal axis of the shaft. Preferably, the muscle treatment device further includes an intermediate member configured to engage the shaft, the intermediate member having an aperture therethrough, wherein the aperture of the shaft and the aperture of intermediate member are coaxial. Preferably, the muscle treatment device further includes a first muscle treatment member having an upper surface and an engagement portion, wherein the engagement portion is configured to engage and be retained within the aperture of the intermediate portion and the aperture of the shaft.

A third aspect of the present invention is a method for facilitating the stretching and/or lengthening of muscles in a body with a muscle treatment device. In accordance with this third aspect, the muscle treatment device preferably includes an elongate rigid shaft and a first muscle treatment member having a convex surface, wherein the first muscle treatment member when engaged to the shaft is prevented from rotating around a longitudinal axis of the shaft. In accordance with one embodiment of this third aspect, the method includes shortening a muscle of the body, contacting skin tissue at a first location of the muscle with the convex surface of the first muscle treatment member such that a vertical axis of the apparatus is substantially perpendicular to a longitudinal axis of the muscle. Preferably, the contact of the first muscle treatment member on the skin tissue is such that it directly affects and/or pins the underlying targeted muscular structure. Preferably, the method further includes applying pressure to the muscle with the muscle treatment device, and angling a contact point of the convex surface of the first muscle treatment member with respect to the skin tissue by rotating the shaft of the apparatus about the longitudinal axis thereof. Preferably, the first muscle treatment member is angled with respect to the skin tissue such that underlying targeted muscular structure is directly affected and/or pinned. Preferably, the method further includes lengthening the muscle.

In accordance with another embodiment of this third aspect, the method further includes removing pressure that was applied to the muscle by the device, shortening the muscle again after having lengthened the muscle, contacting skin tissue in a second location of the muscle, such that it directly affects and/or pins the underlying targeted muscular structure, by rotating the shaft of the apparatus about the with the convex surface of the first muscle treatment member, applying pressure to the muscle again with the devices, and lengthening the muscle again.

In accordance with yet another embodiment of this third aspect, the method further includes following a grid pattern on the muscle being treated by repeating the steps of removing pressure from the muscle, shortening the muscle again, contacting skin tissue such that it directly affects and/or pins the underlying targeted muscular structure, in a plurality of different locations than the first and second locations with the convex surface of the first muscle treatment member, applying pressure to the muscle again with the device, and lengthening the muscle again.

In accordance with still yet another embodiment of this third aspect, angled pressure is applied to the apparatus such that the contact point of the convex outer surface of the first muscle treatment member is angled with respect to the skin tissue. The application of angled pressure preferably causes the underlying targeted muscular structure of to muscle to be directly affected and/or pinned. In order to apply angled pressure, the shaft of the device may be rotated approximately 5 to 85°, to pin and grip the muscle about the longitudinal axis thereof.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION

As used herein, when referring to bones or other parts of the body, the term "proximal" means closer to the heart and the term "distal" means more distant from the heart. The term "inferior" means toward the feet and the term "superior" means toward the head. The term "anterior" means toward the front part of the body, or the face, and the term "posterior" means toward the back of the body. The term "medial" means toward the midline of the body and the term "lateral" means away from the midline of the body.

Figure 1:
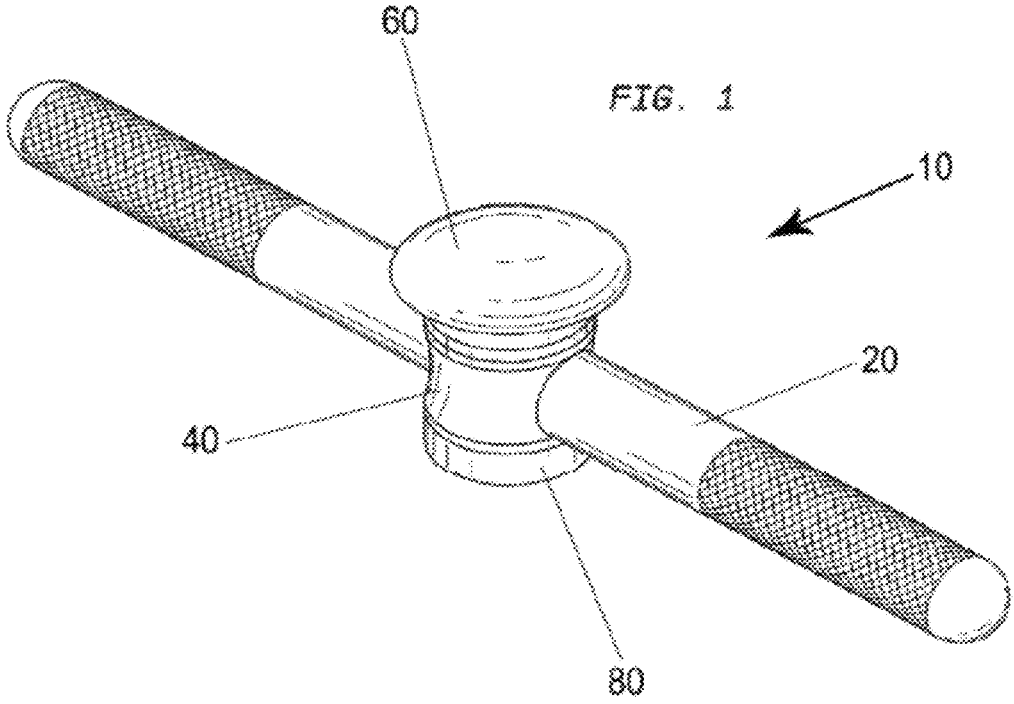
FIG. 1 is an isometric assembled view of an embodiment of a muscle treatment device of the present invention.
Figure 2:
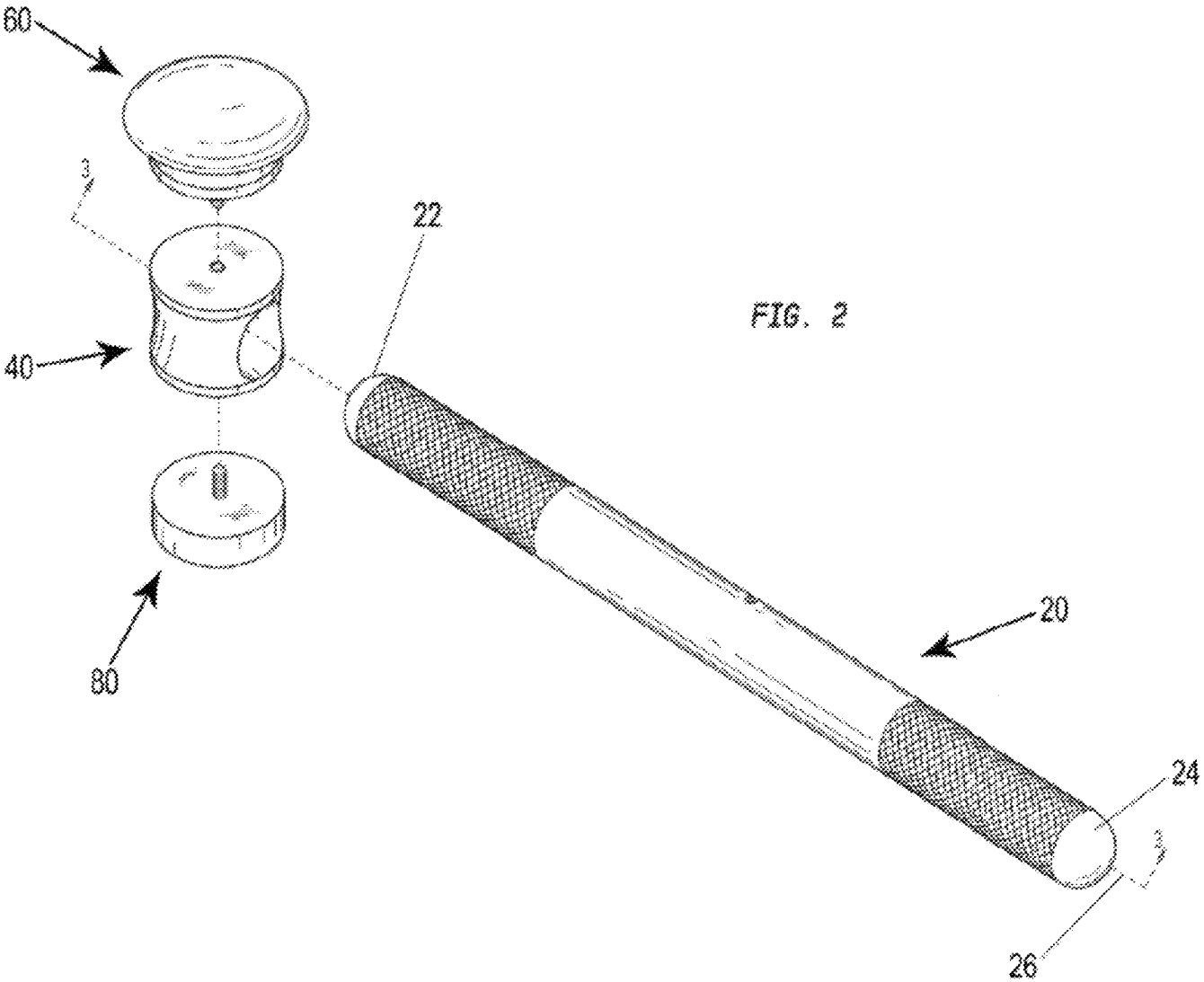
FIG. 2 is an exploded view of the muscle treatment device shown in FIG. 1.
Figure 3:
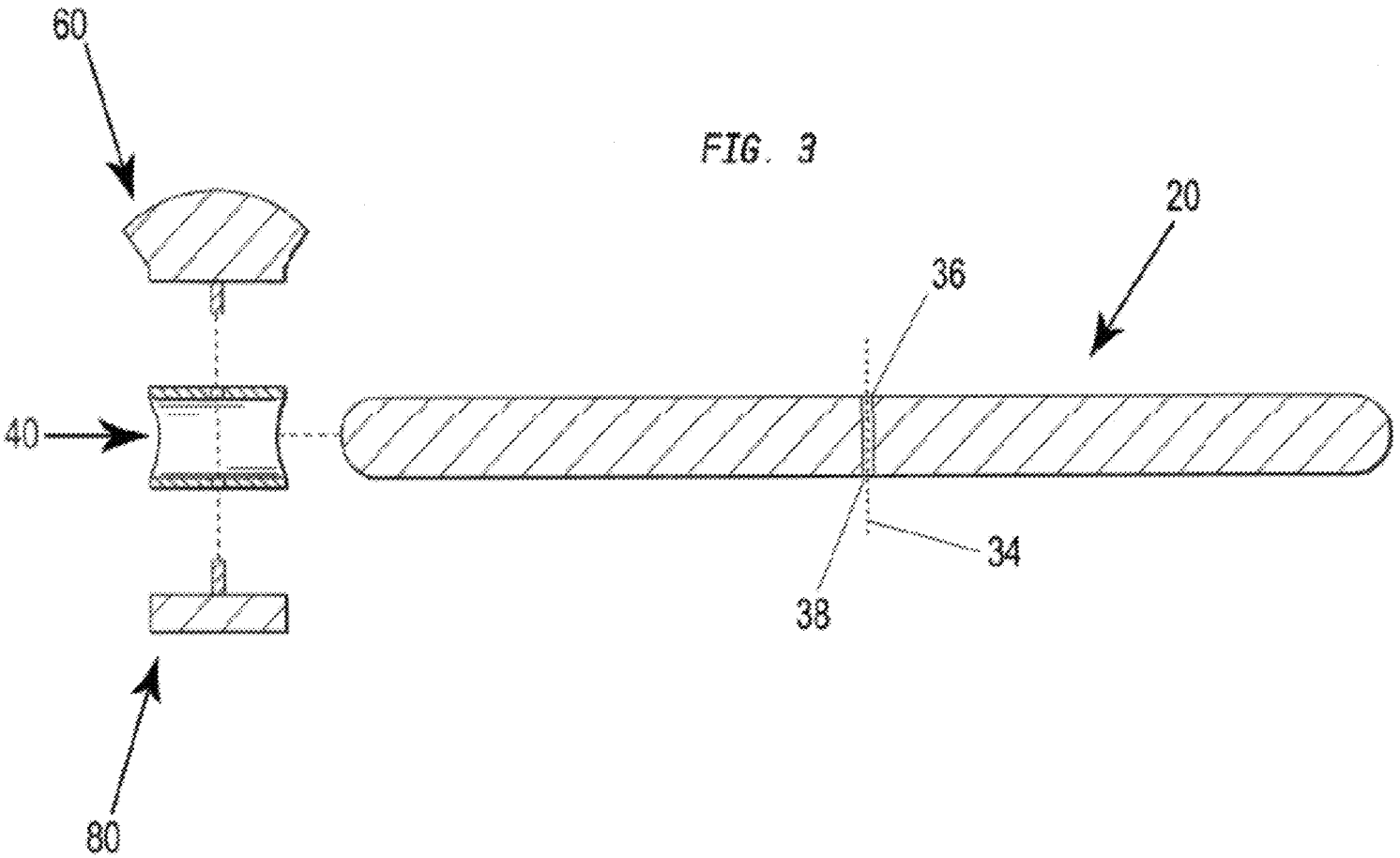
FIG. 3 is a cross-sectional view taken along line 3-3 of the muscle treatment device shown in FIG. 2.

Referring to the drawings, wherein like reference numerals represent like elements, there is shown in the figures, in accordance with embodiments of the present invention, a muscle treatment device for applying pressure to and facilitating the stretch of muscles in a body, designated generally by reference numeral 10. As shown in FIGS. 1-3, muscle treatment device 10 includes an elongate rigid shaft 20, an intermediate member 40, a first muscle treatment member 60, and a second muscle treatment member 80.

Figure 4:
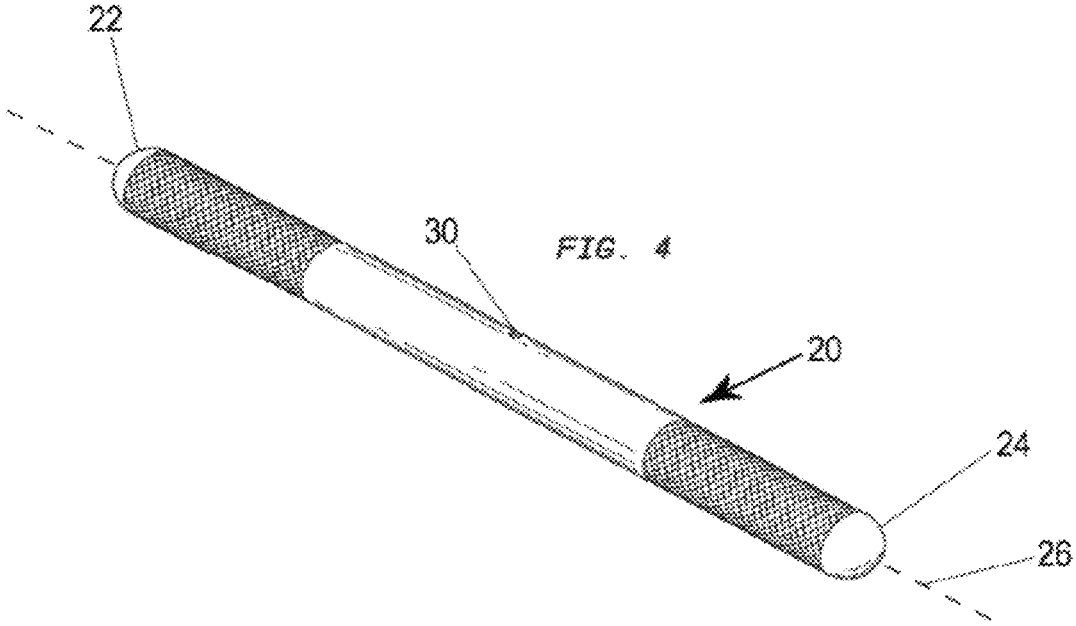
FIG. 4 is a perspective view of the elongate rigid shaft of the muscle treatment device shown in FIGS. 1-3.
Figure 5:
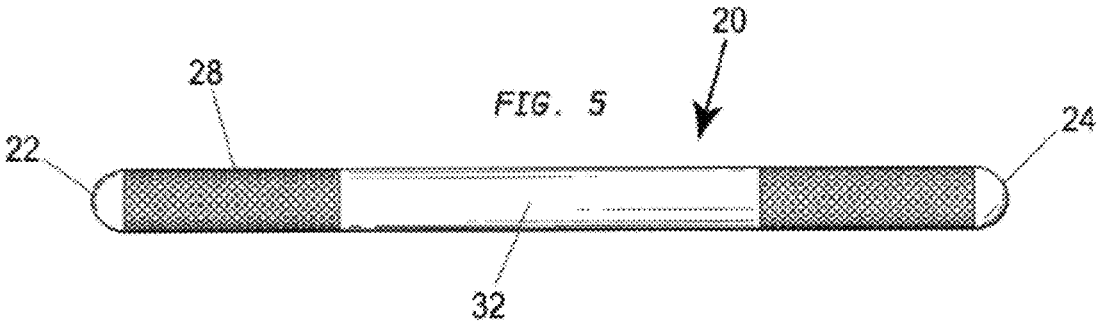
FIG. 5 is a front view of the elongate rigid shaft shown in FIG. 4.

FIG. 4 is a perspective view of elongate rigid shaft 20 of muscle treatment device 10. Shaft 20 is preferably of a sufficient length that it may be held by both left and right hands of a user. Shaft 20 includes a first end 22, a second end 24, and a longitudinal axis 26 passing through first and second ends 22, 24. Shaft 20 is preferably circular such that it can be easily grasped by the hands of a user. It should be understood that shaft 20 may be of any other shape that could be easily grasped by a user such as cylindrical, elipsoidal, rectangular or ovular, for example. The diameter of shaft 20 is preferably constant through the length thereof. Preferably, the diameter is in a general range of between 2 to 8 centimeters and is configured such that it can be easily grasped by the hands of a user. An outer surface 28 of shaft is preferably knurled adjacent the first and second ends 22, 24, such that in use, the users hands are less likely to slip off of shaft 20 when applying pressure to the muscles being treated.

As shown in FIGS. 3-4, shaft 20 further includes an aperture 30 located through an intermediate portion 32 thereof. Preferably, aperture 30 is located in the middle of shaft 20 between first and second ends 22, 24. Aperture 30 includes an axis 34 that is preferably perpendicular to longitudinal axis 26 of shaft 20. Preferably, aperture 30 is threaded throughout its entire length, but may be only threaded adjacent a first end 36 and a second end 38 of aperture 30. Shaft 20 is preferably made of a strong lightweight material such as aluminum or plastic, for example. While shaft 20 may be made of either of these materials, or the like, it is important that shaft 20 have a rigid structure such that when shaft 20 is used to apply pressure to a muscle being treated it does not bend or break. It is possible that if enough pressure is applied to shaft 20, it may flex slightly along the length thereof, but not to any significant degree.

Figure 6:
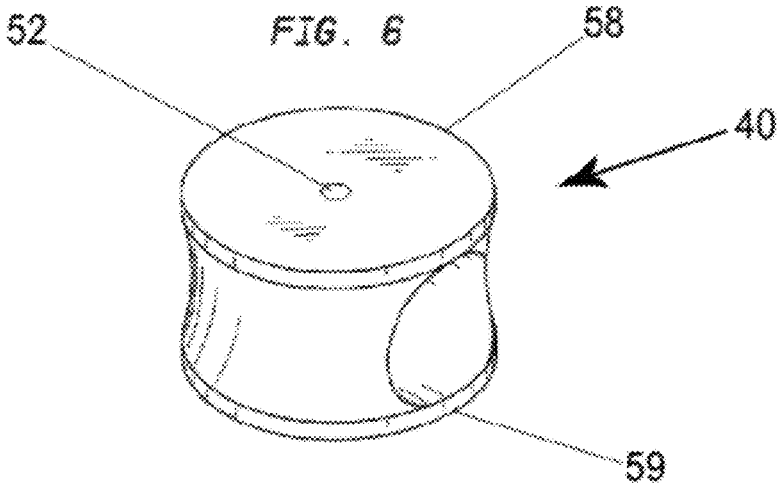
FIG. 6 is a perspective view of the intermediate member of the muscle treatment device shown in FIGS. 1-3.
Figure 7:
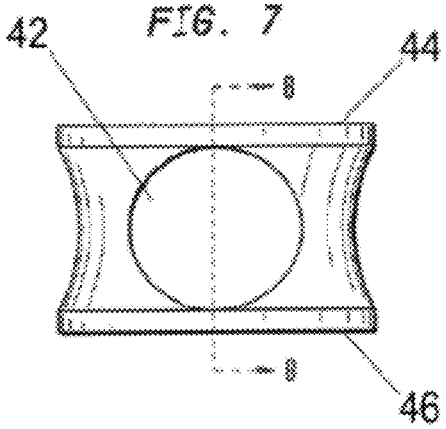
FIG. 7 is a front view of the intermediate member shown in FIG. 6.
Figure 8:
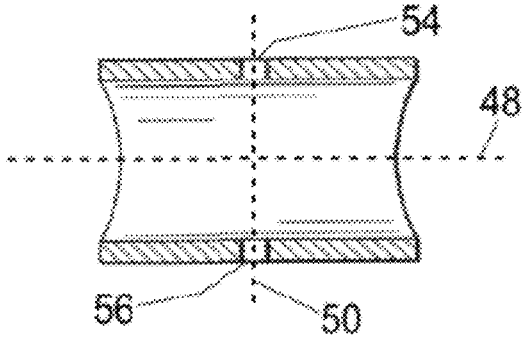
FIG. 8 is a cross-sectional view taken along line 8-8 of the intermediate member shown in FIG. 7.

FIGS. 6-8 show intermediate member 40 of muscle treatment device 10. Intermediate member 40 is configured to slidably couple to shaft 20 by sliding either first or second ends 22, 24 of shaft 20 through an aperture 42 of intermediate member 40 until intermediate member 40 is located adjacent intermediate portion 32 of shaft 20. The diameter of aperture is substantially equivalent or slightly less than the diameter of shaft 20 such that intermediate member 40 fits snugly on shaft 20 and does not easily rotate with respect to shaft 20 without a force being imparted thereon to affect the rotational relationship between intermediate member 40 and shaft 20. Intermediate member 40 includes generally flat upper and lower surfaces 44, 46. Aperture 42 of intermediate member 40 has an axis 48 which is preferably co-linear with axis 26 of shaft 20 when intermediate member 40 is coupled to shaft 20. Intermediate member preferably further includes an aperture 52 that passes through generally flat lower and upper surfaces 44, 46 of intermediate member 40. Aperture 52 of intermediate member 40 has an axis 50 which is preferably co-linear with axis 34 of shaft 20 when intermediate member 40 is coupled to shaft 20. Axis 50 of aperture 52 is preferably perpendicular to axis 48 of intermediate member 40. Intermediate member 40 is substantially hollow such that aperture 52 of intermediate member 40 produces a first aperture 54 adjacent generally flat lower surface 44 and a second aperture 56 adjacent generally flat upper surface 46.

Figure 9:
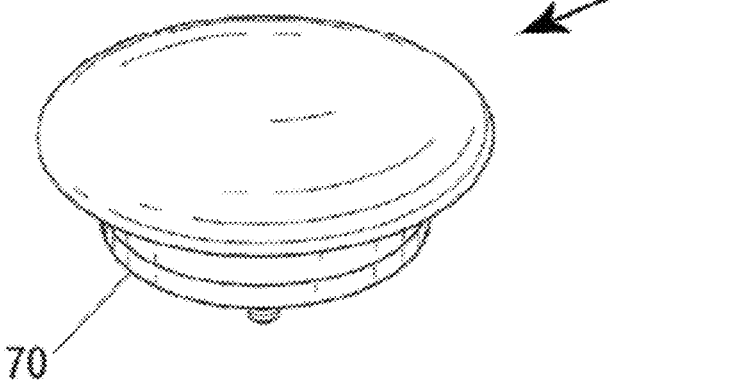
FIG. 9 is a perspective view of the first muscle treatment member of the muscle treatment device shown in FIGS. 1-3.
Figure 10:
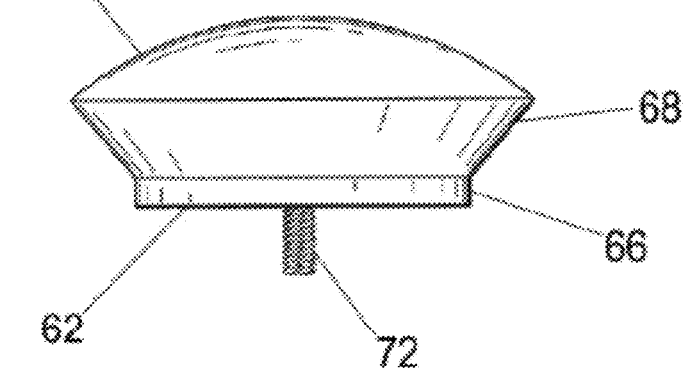
FIG. 10 is a front view of the first muscle treatment member shown in FIG. 9.

FIGS. 9-10 show first muscle treatment member 60 of muscle treatment device 10. First muscle treatment member 60 preferably has a generally flat lower surface 62 corresponding to generally flat upper surface 44 of intermediate member 40. Generally flat lower surface 62 of first muscle treatment member 60 and generally flat upper surface 44 of intermediate member 40 are preferably configured to matingly engage such that there is first muscle treatment member 60 is securely coupled to intermediate member 40 when fastened thereto. First muscle treatment member 60 further includes a convex upper surface 64. Convex upper surface 64 is preferably configured to produce a point load on the muscle being treated without causing pain to the user. Intermediate portions 66 and 68 are preferably located intermediate generally flat lower surface 62 and convex upper surface 64 of first muscle treatment member 60. Intermediate portion 66 of first muscle treatment member 60 is substantially perpendicular to generally flat lower surface 62. Intermediate portion 66 is configured to provide first muscle treatment member 60 with some height such that convex upper surface 64 is spaced a certain distance from outer surface 28 of shaft 20. Intermediate portion 68 is preferably angled with respect to intermediate portion 66. The angle that intermediate portion 68 has with respect to intermediate portion 66 preferably determines the convexity of upper surface 64 of first muscle treatment member 60.

As shown in FIGS. 9-10, a diameter 70 of generally flat lower surface 62 is preferably equivalent to a diameter 58 of generally flat upper surface 44 of intermediate member 40. An engagement portion 72 preferably extends outwardly from generally flat lower surface 62 of first muscle treatment member 60. Preferably, engagement portion 72 is threaded on at least a portion thereof.

Figure 11:
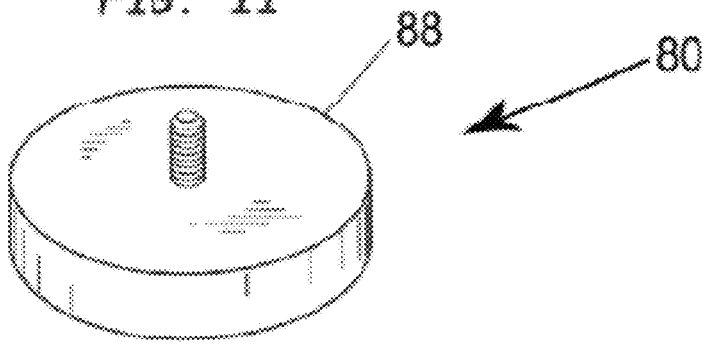
FIG. 11 is a perspective view of the second muscle treatment member of the muscle treatment device shown in FIGS. 1-3.
Figure 12:
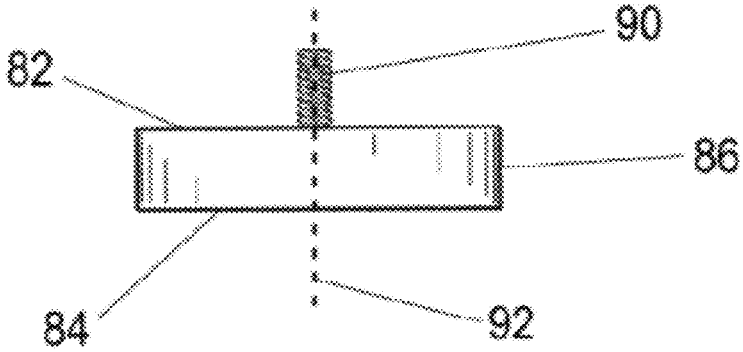
FIG. 12 is a front view of the second muscle treatment member shown in FIG. 11.

FIGS. 11 and 12 show second muscle treatment member of muscle treatment device 10. Second muscle treatment member 80 includes a generally flat lower surface 82 corresponding to generally flat lower surface 46 of intermediate member 40. Second muscle treatment member 80 further includes an upper surface 84 that is preferably flat but may also have convexity much like convex upper surface 64 of first muscle treatment member 60. The shape of upper surface 84, whether flat or convex, is generally determined by the muscle treatment needed for a particular user or patient. Second muscle treatment member 80 further includes a side surface 86 located between lower and upper surfaces 82, 84. A diameter 88 of generally flat lower surface 82 is preferably equivalent to a diameter 59 of generally flat lower surface 46 of intermediate member 40. An engagement portion 90 preferably extends outwardly from generally flat upper surface 82 of second muscle treatment member 80. Engagement portion 90 is preferably threaded on at least a portion thereof. Second muscle treatment member 80 includes a longitudinal axis 92 passing through generally flat lower and upper surfaces 82, 84.

FIGS. 1-3 show an assembled, exploded and cross sectional view of muscle treatment device 10 respectively, including elongate shaft 20, intermediate member 40, first muscle treatment member 60, and second muscle treatment member 80. In assembling the parts of muscle treatment device 10, intermediate member 40 is first slidably coupled to elongate shaft 20 in the manner described above. Intermediate member 40 is located on elongate shaft 20 in a correct position when aperture 52 of intermediate member is coaxial with aperture 34 of elongate shaft 20. First muscle treatment member 60, and/or second muscle treatment member 80 may then be coupled to intermediate member 40 and elongate shaft 20. Preferably, engagement portion 72 of first muscle treatment member 60 passes through first end 54 of aperture 52 of intermediate member 40 and is threaded into threaded first end 36 of aperture 30 of elongate shaft 20 until lower surface 62 of first muscle treatment member 60 matingly engages upper surface 44 of intermediate member 40. Engagement portion 90 of second muscle treatment member 80 passes through second end of aperture 52 of intermediate member 40 and is threaded into threaded second end 38 of aperture 30 of elongate shaft 20 until lower surface 82 of second muscle treatment member 80 matingly engages lower surface 46 of intermediate member 40. The mating engagement between each of first and the second muscle treatment members 60, 80 with intermediate member 40 allows a substantial amount of force to be applied to each muscle treatment member 60, 80 while aiding and maintaining their position with respect to elongate shaft 20. Further, muscle treatment members 60, 80 are engaged to intermediate member 40 and elongate shaft 20 such that each member 60, 80 is prevented from rotating around longitudinal axis 26 of elongate shaft 20.

Figure 21:
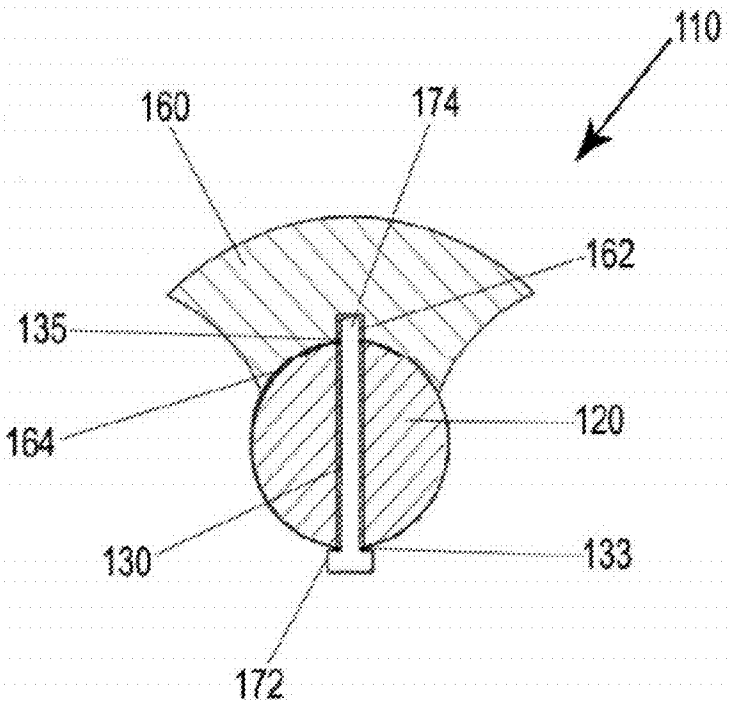
FIG. 21 is a cross-sectional view of an alternative embodiment of a muscle treatment device of the present invention.

FIG. 21 shows another embodiment of a muscle treatment device. This figure is a cross-sectional view taken along a plane perpendicular to the longitudinal axis of the elongate shaft. As shown, muscle treatment device 110 includes a first muscle treatment member 160, an elongate shaft 120, and an engagement member 172. In this embodiment, there is no intermediate member coupled between first muscle treatment member 172 and elongate shaft 120. First muscle treatment member 160 preferably includes a concave bottom surface 164 shaped to matingly engage the convex outer surface of elongate shaft 120. Preferably, a recess 162 is formed in concave bottom surface 164 of first muscle treatment member 160. Elongate shaft 120 preferably includes an aperture 130 therethrough, wherein aperture 130 has first and second ends 133, 135.

In coupling first muscle treatment member 160 and elongate shaft 120 to one another, a first end 174 of engagement member 172 passes entirely through first and second ends 133, 135 of aperture 130 and is then threaded into recess 162 of first muscle treatment member 160.

A kit for muscle treatment 10 may be provided. Such a kit preferably includes elongate shaft 20, intermediate member 40, first muscle treatment member 60, and second muscle treatment member 80. Preferably, each kit includes one elongate shaft 20 and one intermediate member 40 configured to couple in the manner described above and a plurality of first and second muscle treatment members 60, 80. Such a kit may include a plurality of first muscle treatment members 60 having varying degrees of convexity on upper surface 64 thereof. Depending upon the muscle treatment needed, first muscle treatment member 60 may include an upper surface 64 with a large convexity when greater point loading is needed to be applied to a muscle of a user. Upper surface 64 may instead have a lesser convexity when lesser point loading on the muscle is needed. Such a kit preferably further includes a plurality of second muscle treatment members 80 having a flat upper surface 84 or an upper surface 84 with varying degrees of convexity.

Figure 13:
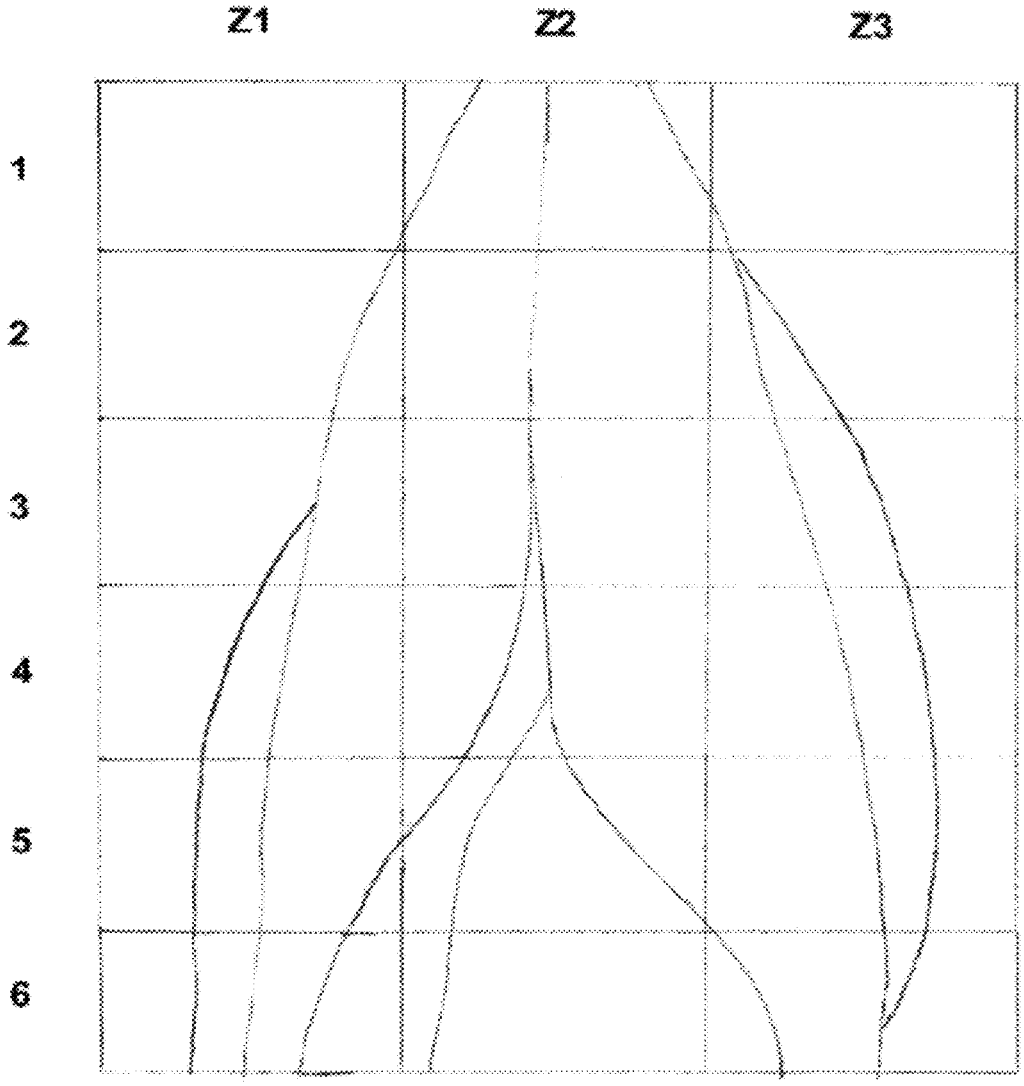
FIG. 13 is a view of an example of a grid pattern on the hamstrings of a patient.

Device 10 is preferably utilized for facilitating the stretching and/or lengthening of muscles in a body. While the following description of using device 10 may include ordered steps, it should be understood that the particular steps described herein are not necessarily followed in the manner described for every muscle treatment scenario and that device 10 may be utilized in a different manner without departing from the scope of the invention. Prior to treating a particular muscle with device 10, the muscle is preferably first broken up into a grid having one or more zones as shown in FIG. 13. Each zone represents a column of the grid running parallel with the longitudinal axis of the muscle. Depending on the size or composition of the muscle being treated, a muscle may have as little as 1 zone for smaller muscles or up to 5 or more zones for larger muscles. For example, the hamstring generally has a greater number of zones than the bicep.

Organizing the muscle to be treated into a grid helps to make sure the muscle is thoroughly treated, with no missed area of treatment, and that variations in the muscle can be dealt with specifically. In one example, the hamstring may include 3 parallel zones (i.e. Z1, Z2, and Z3 as shown in FIG. 13) each running along the longitudinal axis thereof. Each zone preferably has 6 separate treatment locations running along the length of the zone, but may have as little as 1 treatment location or more than 6 treatment locations. If the zones represent columns of the grid, then the plurality of treatment locations of each zone represents the rows of the grid. Thus, in the present example, the hamstring would have a total of 18 treatment locations that the muscle treatment device may be utilized on. Each of these 18 treatment locations do not have to be treated in one treatment regimen. Treatment may be restricted to only those locations where the user or patient feels pain or muscle treatment is prescribed.

Figure 13A:
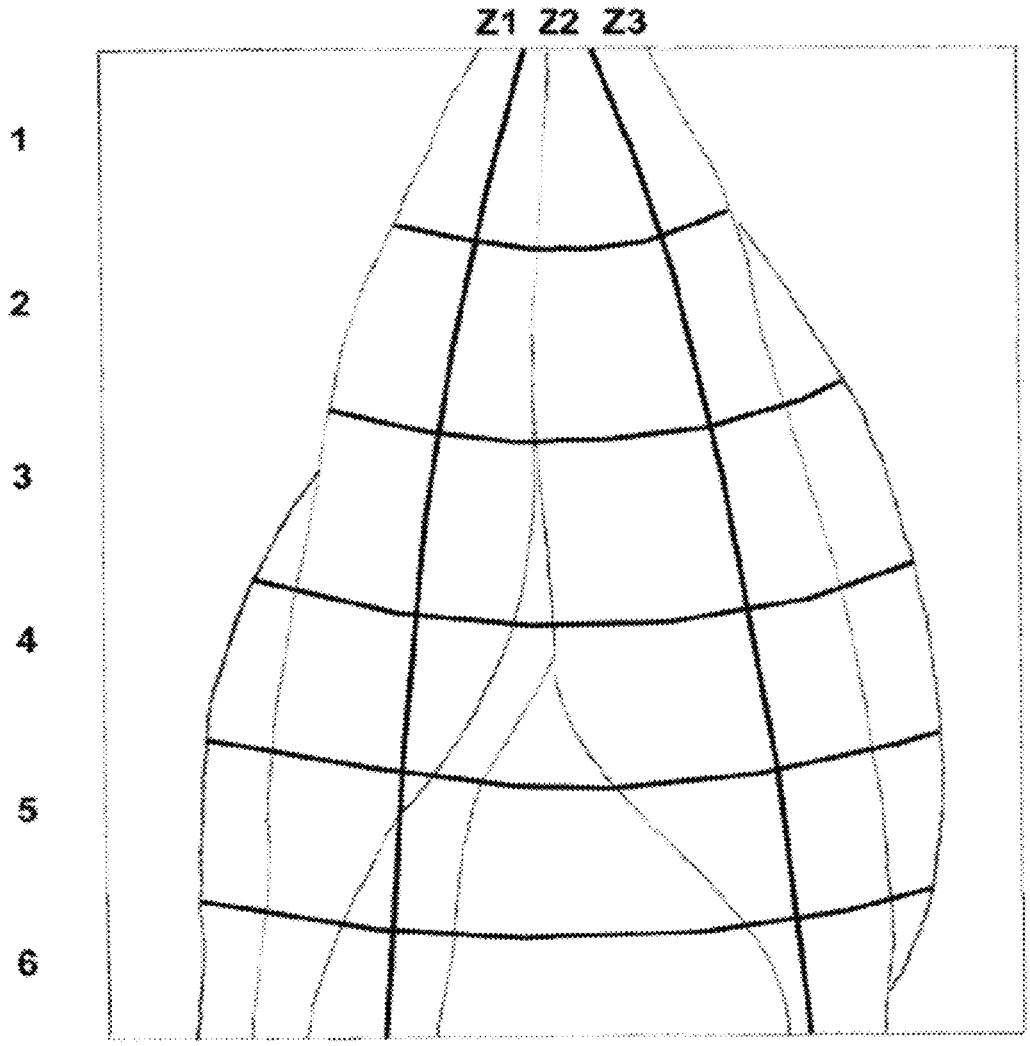
FIG. 13A is a view of another example of a grid pattern on the hamstrings of a patient.

Another example of a grid pattern is shown in FIG. 13A. The grid pattern in this example preferably still includes columns and rows, but the columns and rows are shaped to conform to the muscle being treated such that each treatment location (i.e. separate boxes that are formed by the columns and rows) includes substantially all muscle of the muscle being treated.

Preferably, when working with healthy tissue, the points of the grid are worked in a proximal direction, from the insertion toward the origin, with pressure angled proximally toward the origin. However, there are instances, such as with injury, where all variations can be employed, such as working grid points from origin to insertion or insertion to origin, and angling pressure proximally or distally, depending on the nature of the injury and what the tissue structure of the patient being treated necessitates.

Placement and orientation of device 10 on the muscle is based on the position and direction of muscle fibers throughout the length of the muscle. A muscle of the body is treated using device 10 by placing device 10 at different treatment locations throughout the surface area of the muscle being treated as well as by positioning the body. The body is preferably positioned in a particular manner to further facilitate the treatment and allow a user to apply a sufficient amount of pressure needed to accomplish the desired muscle treatment. While a medical doctor, physical therapist, chiropractor, or the like, may utilize device 10 on patients, the muscle treatment device 10 as will be described herein is structured to allow a person to provide muscle treatment to his or herself.

Figure 14:
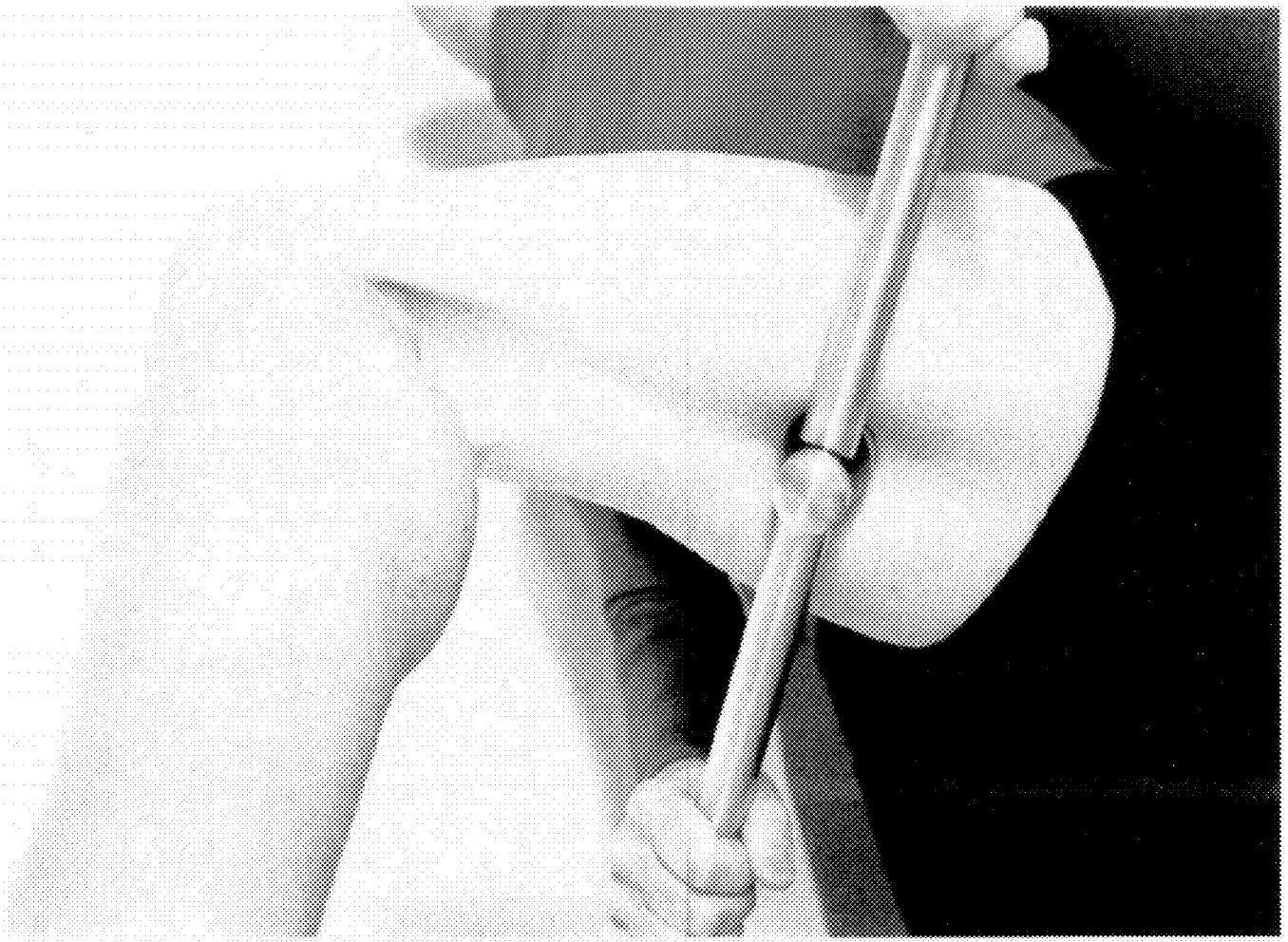
FIG. 14 is a view of a muscle treatment member brought into contact with skin tissue, such that it directly affects and/or pins the underlying targeted muscular structure at a muscle treatment location of the muscle being treated.

One method for facilitating the stretching and/or lengthening of a muscle in a body with muscle treatment device 10 includes first shortening the muscle. For instance, in the case of treating a patient's hamstring, the patient shortens the hamstring by preferably lying on his or her back with one leg bent to 90° at the hip and the knee, while the other leg is preferably straight. Generally, to shorten a muscle, the patient performs the muscle's action to its endpoint and then releases that contraction, and/or the origin and insertion of the muscle are brought closer together, so that there is a minimum amount of tension on the muscle and surrounding structures, and such that the muscle is in a relaxed and slackened state. As shown in FIG. 14, an outer surface of a muscle treatment member of device 10 is then brought into contact with skin tissue, such that it directly affects and/or pins the underlying targeted muscular structure at a first muscle treatment location of the muscle.

Figure 15:
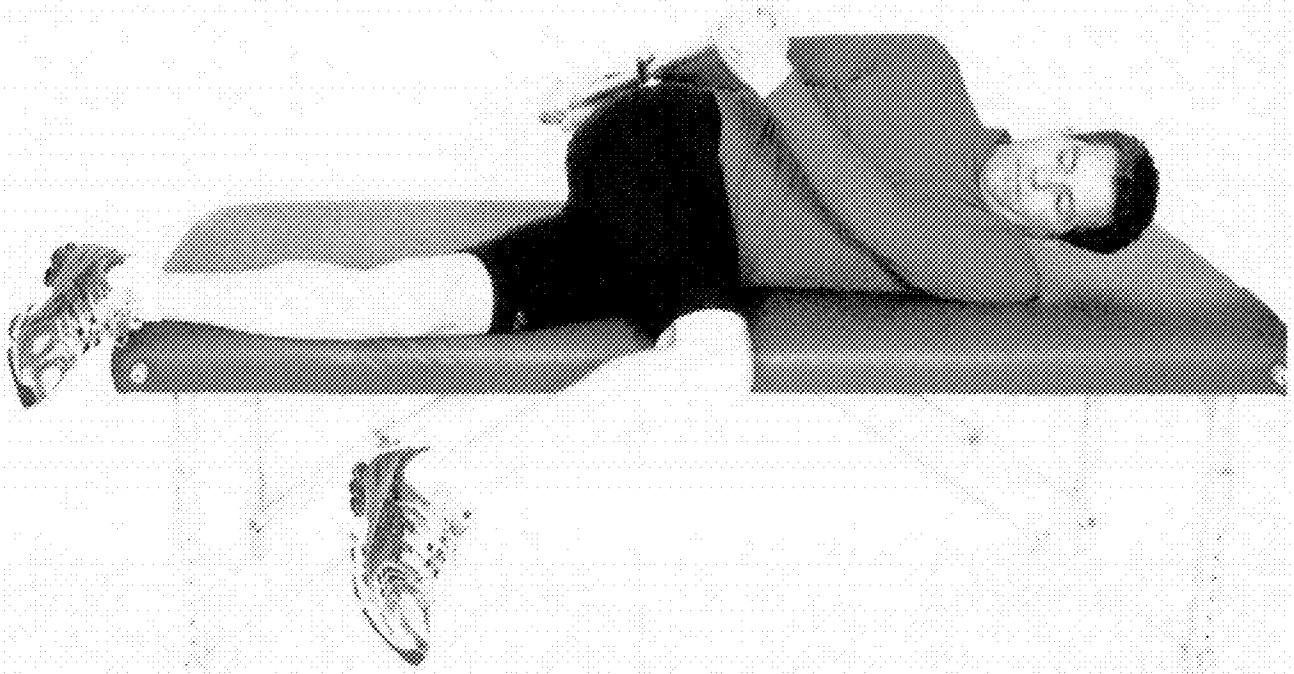
FIG. 15 is a view of applying angled pressure to the muscle being treated in FIG. 14.
Figure 16:
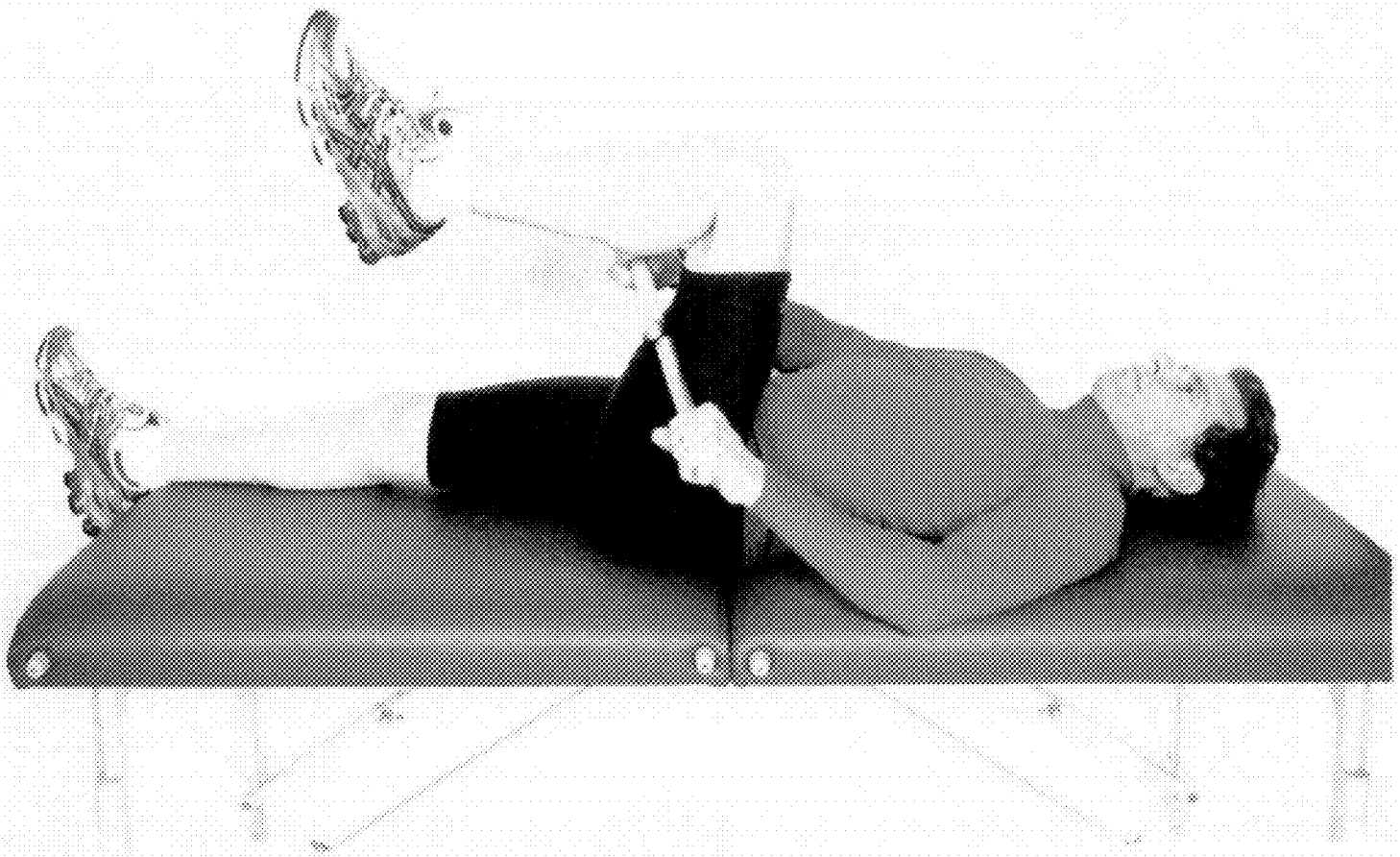
FIG. 16 is a view of the lengthening the muscle being treated in FIG. 14 while angled pressure is being applied to the muscle with the muscle treatment device

In the case of the hamstring, device 10 may first contact skin tissue behind the thigh in the depression between the medial hamstring and the adductor magnus and/or adductor group. Preferably, pressure is then applied to the muscle with device 10 such that a vertical axis of the device is substantially perpendicular to a longitudinal axis of the muscle. Device 10 is then preferably angled such that a contact point of the outer surface of the first muscle treatment member with respect to the skin tissue such that underlying targeted muscular structure is directly affected and/or pinned, occurs by rotating the shaft of device 10 about the longitudinal axis thereof in a first rotational direction as shown in FIG. 15. For instance, pressure is preferably applied in the space between the medial hamstring and the adductor and then rotated in the manner described such that the muscle treatment member contacting skin tissue, such that it directly affects and/or pins the underlying targeted muscular structure, points toward the hip joint. The patient should preferably feel device 10 "catch" the skin and underlying targeted muscle tissue. After the device 10 is caught in position, the muscle is preferably lengthened as shown in FIG. 16. In the case of the hamstring, the hamstring is lengthened by straightening the bent leg. To lengthen the muscle, the patient would perform, to tolerance, the action of the muscle acting as the antagonist to the target muscle, and/or the origin and insertion of the target muscle would be brought further away from each other, thereby generating tension within the target muscle, and on the surrounding structures such that the target muscle is taut or in a state of tension, without an active contraction of the target muscle. Preferably, the antagonist movement stretches and/or lengthens the muscle and simultaneously forces it to relax.

Figure 17:
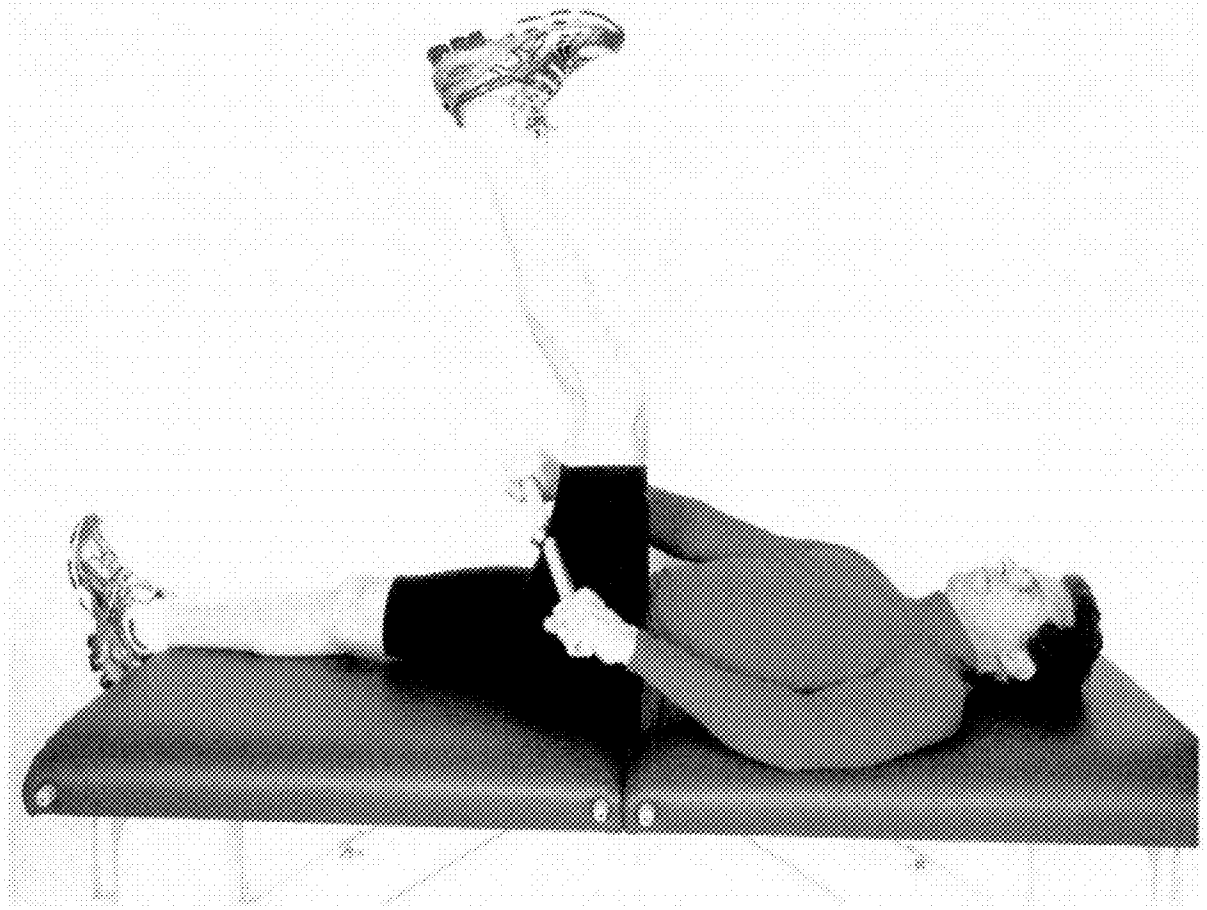
FIG. 17 is a view of the patient facilitating their stretch while incorporating stretch bands into the muscle treatment technique.
Figure 18:
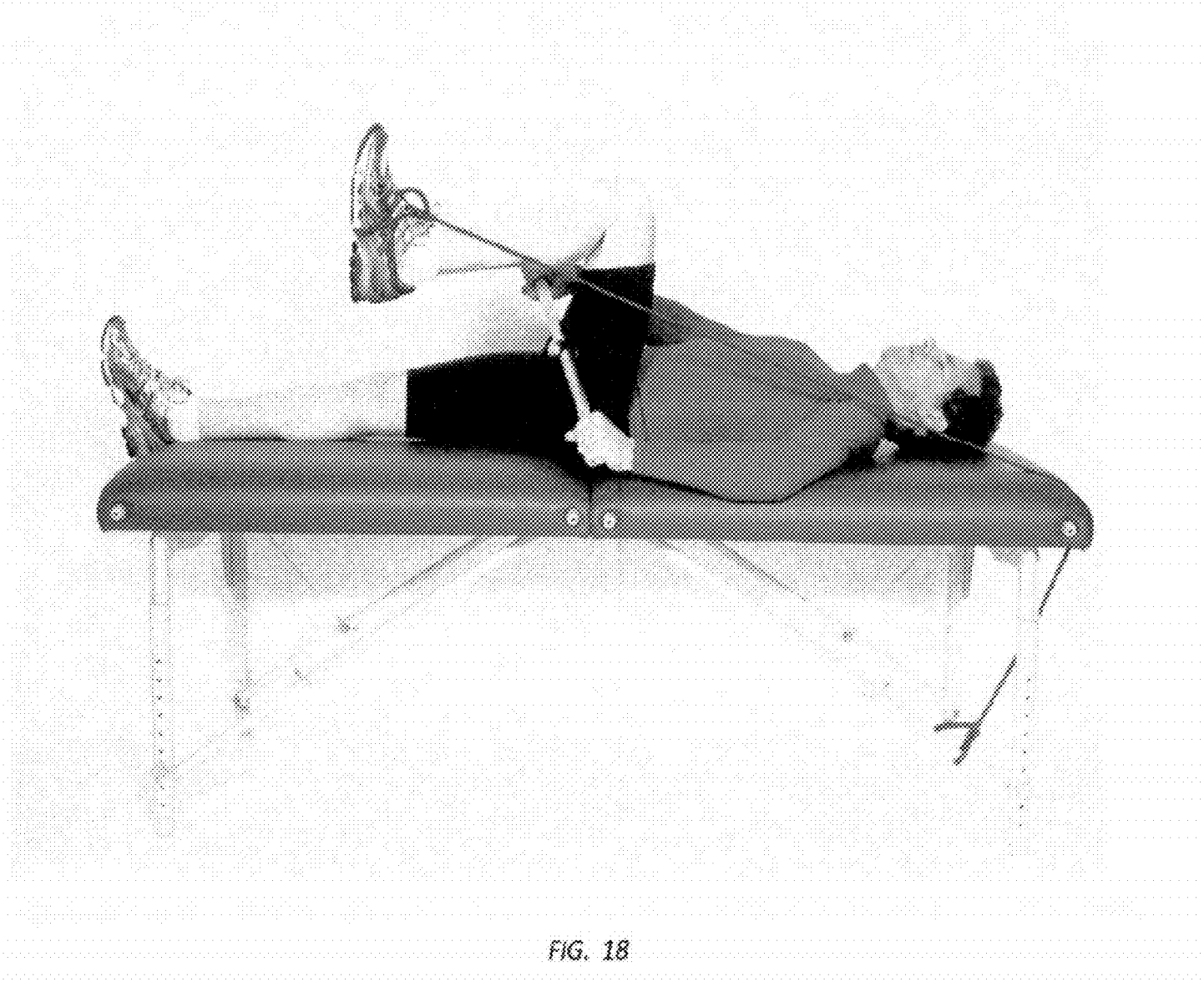
FIG. 18 is another view of the patient facilitating their stretch while incorporating stretch bands into the muscle treatment technique.

To further facilitate the stretching and/or lengthening of muscle, the patient may utilize the assistance of stretch bands known in the art as shown in FIGS. 17 and 18, or other external devices. In FIG. 17, one end of a stretch band is tied to a table while the other end is wrapped around the patient's foot while the patient's left leg is in a bent position (i.e. hamstring is shortened). In FIG. 18, the hamstring is shown lengthened as the patient's left leg is in a straightened position.

In one method of the invention, first or second muscle treatment members 60, 80 of device 10 may be placed on skin tissue such that it directly affects and/or pins the underlying targeted muscular structure, surrounding muscle in a first zone thereof at a first muscle treatment location. A therapeutic regimen may include the steps outlined above for each muscle treatment location in one or more zones depending on the size of the muscle being treated. All points at which to apply pressure on the skin tissue such that it directly affects and/or pins the underlying targeted muscular structure surrounding the muscle are between a particular muscle's origin and insertion, or on or between the fascial connections between the muscles themselves.

A stretch done by a patient without the aid of device 10, or any like device, increases the tension at the ends of the particular muscle where the less elastic tendon attaches the muscle to bone. The middle of the muscle tissue generally tends to stretch somewhat, but is usually limited by the tension increase at the ends of the muscle. Device 10 preferably allows a patient to facilitate stretching and/or lengthening of a muscle being treated, by pinning the muscle to create a new origin or insertion point. For instance, in the case of stretching the hamstring, if a patient were to contact skin tissue, such that it directly affects and/or pins the targeted underlying muscular structure, around the midpoint of the hamstring, and then rotate device 10 such that a muscle treatment member is angled toward the hip joint, when lengthening the muscle the stretch would now occur generally at a midpoint between the knee joint and the midpoint of the hamstring rather than just at the midpoint of the hamstring. Thus, by affecting the origin of the muscle (or functionally creating a new origin), the location, or focus, of the tension in the muscle being stretched is also affected.

In order to obtain full therapeutic tension throughout a muscle and supporting structures, the "end tension" must be redistributed over all aspects of the muscle. The use of device 10 in the above described manner achieves this by pinning the muscle to create a new temporary origin or insertion, thereby determining where the end is and thus where the end tension accumulates. The end tension can actually be harnessed and applied by using device 10 to control and focus the tension in a particular spot. It prevents the tension from dissipating over too great an area, which would result in a weaker less therapeutic treatment and stretch. Thus, device helps to increase that end stretch in lesser-stretched middle parts of the tissue by changing the functional origin and insertion points of the muscle being treated.

Figure 19:
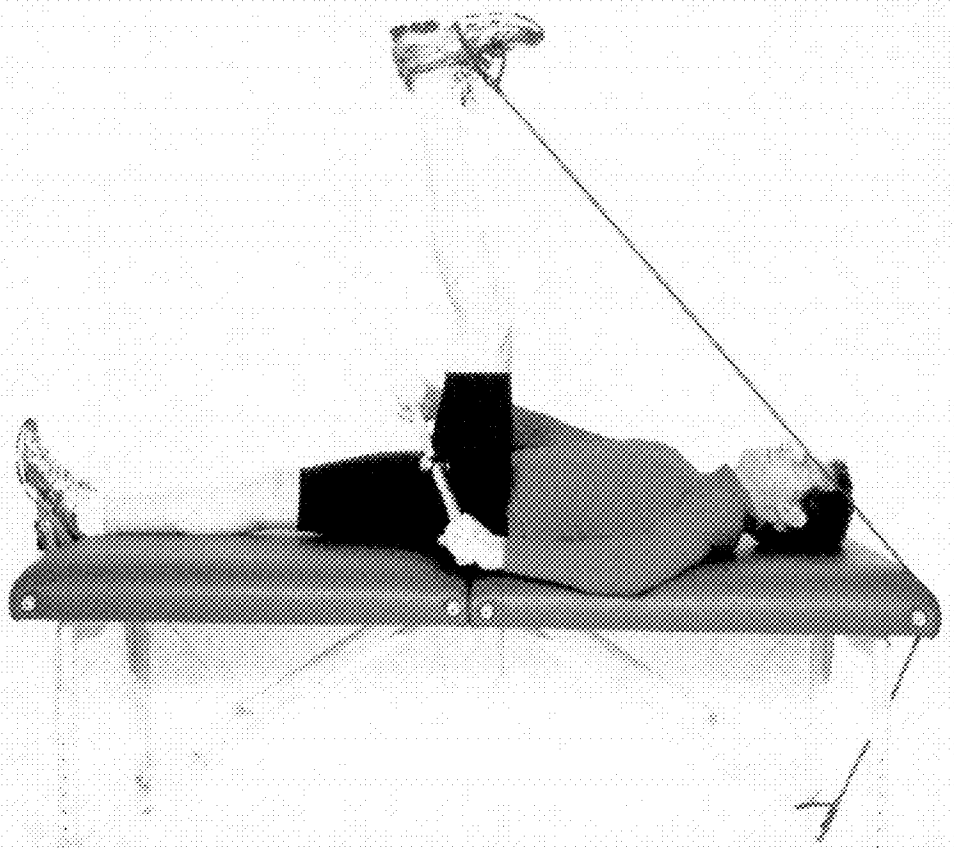
FIG. 19 is a view of a patient applying pressure to a muscle being treated with the muscle treatment device of the present invention while sidelying.
Figure 20:
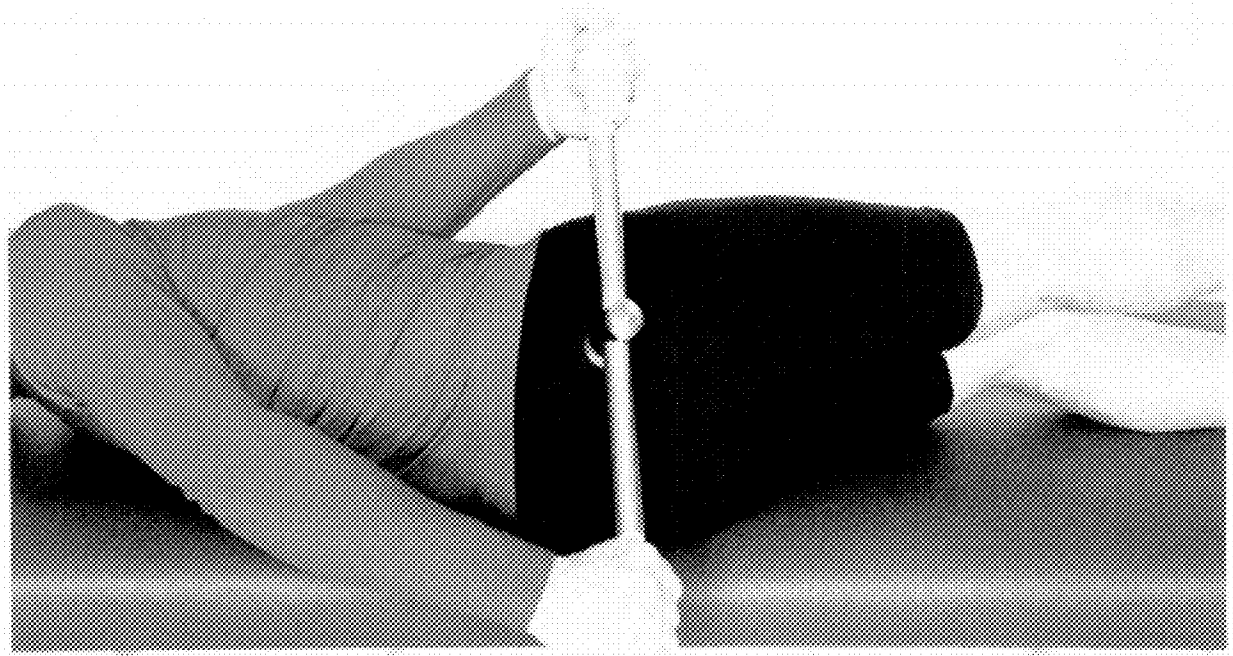
FIG. 20 is another view of a patient applying pressure to a muscle being treated with the muscle treatment device of the present invention while sidelying.

Other muscles that may be treated are located in the area of the hip, for example. Such muscles include, for example, the gluteus maximus, gluteus medius, and gluteus minimus. These muscles generally run across the back and side of the hip to the leg. They extend and abduct the leg. In treating these muscles using device 10, a patient can either be standing, seated or sidelying to perform this stretch such as shown in FIGS. 19 and 20.

If the patient is sidelying, the patient preferably lies on their side with the target hip up. The patient brings his or her straightened leg back, so that the target muscle is loose. Preferably, the patient then applies tension to the muscle with device 10, using angular pressure, and pins the muscle at regular intervals along the muscle from the knee towards the hip in predetermined zones. Each time the muscle is pinned, the muscle is brought through the movement pattern described above. In this case, the patient flexes the knee and hip up towards the chest and slightly across the body, until the muscle is stretched and/or lengthened.

This can also be done seated, but will only get the superior fibers of the gluteus medius and minimus. In this case, the patient preferably sits, applies tension with device 10 at regular intervals from the hip up along the zones. Each time tension is applied, the patient preferably leans away and forward from the hip to stretch and/or lengthen the muscle.

Another example of muscles that may be treated includes the piriformis and deep lateral rotators (i.e. quadratus lumborum, obdurator internus, gemellus superior and inferior). These are a group of small muscles that run from the sacrum and hip bone to the top of the leg bone. These muscles function to rotate the leg externally at the hip. These muscles can be treated by standing or sidelying.

If the patient is sidelying, the patient preferably lies on his or her side with the target hip up. The patient preferably brings their straightened leg back, so that the target muscle is loose. As described with respect to the muscles of the hip, the patient then preferably applies tension to the muscle with device 10, using angular pressure, and pins the muscle at regular intervals along the muscle from the outer hip area toward the sacrum, in predetermined zones or in zones as needed. Each time the muscle is pinned, the muscle is brought through the movement pattern described above. In this case, the patient flexes the knee and hip up towards the chest and slightly across the body, internally rotating the hip, until the muscle is stretched and/or lengthened.

Yet another example of a muscle that may be treated includes the tensor fascia latae. This muscle preferably runs from the top of the lateral hip into the fascial band on the side of the leg, and helps to flex the hip, internally rotate, and abduct the hip.

If the patient is standing, the patient preferably stands with their hip and knee flexed such that it is rotated in and away from the body, so that the muscle is loose. Angular pressure is preferably applied with device 10 at regular intervals along the muscle's zone, in the direction of the hip. With each application of pressure, the hip is preferably extended and leg straightened and brought slightly towards the body, with the hip rotated out, to stretch and/or lengthen the muscle.

Even yet another example of a muscle that may be treated includes the sartorius. This muscle preferably starts at the front of the hip bone and travels down the leg crossing the knee to attach at the front of the inside of the lower leg below the knee. It flexes the hip, bends the knee and externally rotates the hip. This muscle can preferably be treated by the patient standing or lying on his or her back.

If the patient is standing or lying on his or her back, the patient preferably bends the knee up to the chest and brings the leg out to the side to shorten the muscle. Angular pressure is preferably applied with device 10 from the hip towards the knee at regular intervals along the muscle's narrow zone. With each application of device 10, the patient preferably straightens the knee and lowers the leg simultaneously, and finally internally rotating the hip to bring the knee in, thus stretching the muscle.

The quadriceps muscle is generally known as the upper leg. The quadriceps muscle is comprised of a group of 4 muscles that generally run from the top of the femur (i.e. the rectus femoris, which attaches to the hip) to the knee. These 4 muscles preferably work together to straighten or extend the knee. The rectus femoris has a minor role in hip flexion.

The quadriceps muscle is preferably treated with the patient seated at the side of a stretch table or in a standing position. Preferably, the patient starts with his or her leg extended to shorten the muscles. Angular pressure is then preferably applied with device 10 from the knee towards the hip at regular intervals along the quadriceps treatment zones. With each application of device 10, the patient preferably bends the knee as far as is tolerable to stretch the muscle. With respect to the vastus lateralis and tensor fascia lata, the movement in order to stretch this zone can be accompanied by adduction. With respect to the rectus femoris, the movement in order to stretch this zone can be accompanied by some hip extension to achieve a full stretch and/or lengthening.

As described in the example above, device 10 may be used to stretch the hamstrings. The hamstrings are comprised of three segments, including two medial hamstrings and one lateral, which run from the base of the back of the hip to the back of the knee. The hamstrings preferably extend the hip and flex the knee. This muscle can be treated with the patient lying on his or her back in the manner described above, for example.

Other muscles or muscle groups that may be treated using device 10, include, for example, the iliotibial band and adductors.

With respect to the lower leg and foot, the gastrocnemius, including the plantaris, soleus, peroneals, tibilis posterior and the deep plantarflexors, the extensor digitorum longus, plantar fascia, flexor digitorum brevis, and quadratus plantae for example may be treated.

With respect to the back, the middle trapezius, rhomboids, erector spinae, including the iliocostalis, longissimus, and spinalis, the multifidi, serratus posterior inferior, and quadratus lumborum for example may be treated.

With respect to the abdomen, the rectus abdominus, external obliques, internal obliques, transversus abdominis, psoas, and iliopsoas for example may be treated.

With respect to the neck the erector spinae, the splenii capitus and cervicis, semispinalis capitis and cervicis, longus colli, upper trapezius, SCM, and scalenes for example may be treated.

The above described muscle and muscle groups may preferably be treated by a medical doctor, physical therapist, chiropractor, or the like, or a patient using device 10 on his or her own muscles. Other muscle groups may be treated that are difficult for one to reach with his or her own hands, such as the upper arm, shoulder, and chest. Either with the assistance from someone else or by holding device 10 differently, these muscle groups may still be treated using device 10. In the case of treating these muscle groups on one's self, device 10 is preferably held with one hand at the muscle treatment members 60 and/or 80, i.e. adjacent intermediate portion 32 of elongate shaft 20, rather than with both hands holding the handles of elongate shaft 20. These muscles can also be treated with the device, by mounting device 10 on a structure and leaning into it in a designated manner to create the proper pressure in the targeted location.

Other muscles that may be treated using the above mentioned methods include the bicep, tricep, brachialis, deltoid, including the anterior, middle, and posterior, the rotator cuff, including the supraspinatus, infraspinatus, and teres minor, the pectoralis major, the pectoralis minor, the lower arm, including the extensor group and flexor group, and the back, including the latissimus and teres major.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An apparatus for applying pressure to and facilitating the stretch of muscles in a body comprising:

an elongate rigid shaft having a longitudinal axis along the length thereof and an aperture extending through the shaft, the aperture having a longitudinal axis perpendicular to the longitudinal axis of the shaft, the shaft having a first lateral portion, an intermediate portion, and a second later portion;

an intermediate member engaging the intermediate portion of the shaft, the intermediate member having a first aperture with a longitudinal axis coaxial with the longitudinal axis of the shaft, generally flat lower and upper surfaces and a second aperture extending through the lower and upper surfaces, wherein the aperture of the shaft and the second aperture of intermediate member are coaxial; and a first muscle treatment member having an upper surface and an engagement portion configured to engage and be retained within the aperture of the shaft and the second aperture of the intermediate member, wherein the first muscle treatment member when engaged to the shaft is prevented from rotating around the longitudinal axis of the shaft.

2. The apparatus of claim 1, wherein the aperture of the shaft and the engagement portion of the first muscle treatment member are both threaded.

3. The apparatus of claim 1, further comprising a first handle member and a second handle member, the first handle member configured to engage and be retained on the first lateral portion of the shaft and the second handle member configured to engage and be retained on the second lateral portion of the shaft.

4. The apparatus of claim 1, wherein the first muscle treatment member has a generally flat lower surface that the engagement portion of the first muscle treatment member extends outwardly therefrom, the generally flat lower surface of the first muscle treatment member configured to matingly engage the generally flat upper surface of the intermediate member when the engagement portion of the first muscle treatment member is retained within the second aperture of the intermediate member and the aperture of the shaft.

5. The apparatus of claim 4, further comprising a second muscle treatment member having a lower surface, an upper surface, and an engagement portion extending outwardly from the lower surface, the engagement portion configured to engage and be retained within the aperture of the shaft.

6. The apparatus of claim 5, wherein the upper surface of the first muscle treatment member is convex.

7. The apparatus of claim 6, wherein the upper surface of the second muscle treatment member is convex.

8. The apparatus of claim 7, wherein a diameter of the convex upper surface of the first muscle treatment member is greater than a diameter of the convex upper surface of the second muscle treatment member.

9. The apparatus of claim 8, wherein the lower surface of the second muscle treatment member is generally flat and is configured to matingly engage the generally flat lower surface of the intermediate member when the engagement portion of the second muscle treatment member is retained within the second aperture of the intermediate member and the aperture of the shaft.

10. The apparatus of claim 9, wherein the second muscle treatment member when engaged to the shaft is prevented from rotating around the longitudinal axis of the shaft.

11. An apparatus for applying pressure to and facilitating the stretch of muscles in a body comprising:

an elongate rigid shaft having a longitudinal axis along the length thereof and an aperture extending through the shaft, the aperture having a longitudinal axis perpendicular to the longitudinal axis of the shaft, shaft having a first lateral, intermediate, and second lateral portions;

an intermediate member engaging the intermediate portion of the shaft, the intermediate member having a first aperture therethrough with a longitudinal axis coaxial with the longitudinal axis of the shaft, the intermediate member having a second aperture with a longitudinal axis perpendicular to the longitudinal axis of the first aperture, wherein the aperture of the shaft and the second aperture of intermediate member are coaxial; and a first muscle treatment member having an upper surface and an engagement portion, wherein the engagement portion is configured to engage and be retained within the second aperture of the intermediate portion and the aperture of the shaft.

12. The apparatus of claim 11, wherein the first muscle treatment member when engaged to the shaft is prevented from rotating around the longitudinal axis of the shaft.

13. The apparatus of claim 11, wherein the aperture of the shaft and the engagement portion of the first muscle treatment member are both threaded.

14. The apparatus of claim 11, wherein the intermediate portion of the shaft has generally flat lower and upper surfaces and the aperture of the intermediate portion extends through the lower and upper surfaces.

15. The apparatus of claim 14, wherein the first muscle treatment member has a generally flat lower surface that the engagement portion of the first muscle treatment member extends outwardly therefrom, the generally flat lower surface of the first muscle treatment member configured to matingly engage the generally flat upper surface of the intermediate member when the engagement portion of the first muscle treatment member is retained within the second aperture of the intermediate member and the aperture of the shaft.

16. The apparatus of claim 15, further comprising a second muscle treatment member having a lower surface, an upper surface, and an engagement portion extending outwardly from the lower surface, the engagement portion configured to engage and be retained within the aperture of the shaft.

17. The apparatus of claim 16, wherein the upper surface of the first muscle treatment member is convex.

18. The apparatus of claim 17, wherein the upper surface of the second muscle treatment member is convex.

19. The apparatus of claim 18, wherein a diameter of the convex upper surface of the first muscle treatment member is greater than a diameter of the convex upper surface of the second muscle treatment member.

20. The apparatus of claim 19, wherein the lower surface of the second muscle treatment member is generally flat and is configured to matingly engage the generally flat lower surface of the intermediate member when the engagement portion of the second muscle treatment member is retained within the second aperture of the intermediate member and the aperture of the shaft.

21. The apparatus of claim 20, wherein the second muscle treatment member when engaged to the shaft is prevented from rotating around the longitudinal axis of the shaft.

22. A method for facilitating the stretch of muscles in a body with an apparatus including an elongate rigid shaft and a first muscle treatment member having a convex surface, wherein the first muscle treatment member when engaged to the shaft is prevented from rotating around a longitudinal axis of the shaft, the method comprising:

shortening a muscle of the body;

contacting skin tissue in a first location of the muscle with the convex surface of the first muscle treatment member such that a vertical axis of the apparatus is substantially perpendicular to a longitudinal axis of the muscle;

applying pressure to the muscle with the apparatus;

angling a contact point of the convex surface of the first muscle treatment member with respect to the skin tissue by rotating the shaft of the apparatus about the longitudinal axis thereof; and lengthening the muscle.

23. The method of claim 22, further comprising:

removing pressure that was applied to the muscle with the apparatus;

shortening the muscle again after having lengthened the muscle;

contacting skin tissue in a second location of the muscle with the convex surface of the first muscle treatment member;

applying pressure to the muscle with the apparatus; and lengthening the muscle again.

24. The method of claim 23, further comprising:

following a grid pattern on the muscle being treated by repeating the steps of removing pressure from the muscle, shortening the muscle again, contacting skin tissue such that it directly affects and/or pins the underlying muscular structure of the muscle in a plurality of different locations than the first and second locations with the convex surface of the first muscle treatment member, applying pressure to the muscle again with the apparatus, and lengthening the muscle again.

* * * * *